US010436396B2

(12) United States Patent
Cao

(10) Patent No.: US 10,436,396 B2
(45) Date of Patent: Oct. 8, 2019

(54) ARTIFICIAL CANDLE AND ITS LIGHT BULB

(71) Applicant: Liling Cao, Shenzhen (CN)

(72) Inventor: Liling Cao, Shenzhen (CN)

( * ) Notice: Subject to any disclaimer, the term of this patent is extended or adjusted under 35 U.S.C. 154(b) by 402 days.

(21) Appl. No.: 15/405,418

(22) Filed: Jan. 13, 2017

(65) Prior Publication Data

US 2018/0003352 A1 Jan. 4, 2018

(30) Foreign Application Priority Data

Jul. 2, 2016 (CN) ..... 2016 2 0728691 U

(51) Int. Cl.

| | |
|---|---|
| ***F21S 6/00*** | (2006.01) |
| ***F21S 10/04*** | (2006.01) |
| ***F21V 3/06*** | (2018.01) |
| ***F21V 3/02*** | (2006.01) |
| ***F21V 7/00*** | (2006.01) |
| ***F21V 23/00*** | (2015.01) |
| ***F21V 23/02*** | (2006.01) |
| ***F21W 121/00*** | (2006.01) |

(52) U.S. Cl.

CPC ..... *F21S 6/001* (2013.01); *F21S 10/04* (2013.01); *F21V 3/02* (2013.01); *F21V 3/062* (2018.02); *F21V 7/00* (2013.01); *F21V 23/002* (2013.01); *F21V 23/02* (2013.01); *F21S 10/043* (2013.01); *F21S 10/046* (2013.01); *F21W 2121/00* (2013.01); *F21W 2121/008* (2013.01)

(58) Field of Classification Search

CPC .... F21W 2121/008; F21S 6/001; F21S 10/04; F21S 10/043; F21S 10/046

See application file for complete search history.

(56) References Cited

U.S. PATENT DOCUMENTS 3,233,093 A 2/1966 Gerlat
5,564,819 A * 10/1996 Yamaguchi ..... H01L 24/97 257/E25.02
6,336,733 B1 1/2002 Huang (Continued)

FOREIGN PATENT DOCUMENTS

CN 102401314 A 4/2012
CN 103574363 A 2/2014

(Continued)

*Primary Examiner* — Bryon T Gyllstrom
*Assistant Examiner* — Colin J Cattanach
(74) *Attorney, Agent, or Firm* — Hemisphere Law, PLLC; Zhigang Ma

(57) ABSTRACT

The present invention provides an artificial candle includes a hollow cylinder, an electric wire, and a light bulb. The light bulb includes a light source with a long strip shape, a cup sleeved on and fixed to the electric wire at a position near the first end of the electric wire, an outer cover covered on the cup, and an inner cover sleeved on the light source and defining a receiving space with the cup for receiving a part of the light source and the second end of the electric wire. The light transmitted of the inner cover is less than that of the outer cover and that of the cup. The inner cover is configured for reflecting light emitted from the part, received in the receiving space, of the light source towards the wire holder and an exposed part of the electric wire. A simulating effect of flame is improved.

20 Claims, 3 Drawing Sheets

(56) References Cited

U.S. PATENT DOCUMENTS

| | | | | |
|---|---|---|---|---|
| 2007/0223216 | A1* | 9/2007 | Jensen | F21S 6/001 362/161 |
| 2012/0300459 | A1* | 11/2012 | Hau | F21S 10/046 362/249.02 |
| 2015/0036348 | A1* | 2/2015 | Dong | F21S 10/046 362/293 |
| 2015/0204498 | A1* | 7/2015 | Hau | F21S 10/046 362/650 |
| 2016/0146414 | A1* | 5/2016 | Dong | F21S 10/046 362/232 |

FOREIGN PATENT DOCUMENTS

| | | | | |
|---|---|---|---|---|
| CN | 203771082 | U | 8/2014 | |
| FR | 2914487 | A1 * | 10/2008 | F21S 6/001 |

* cited by examiner

ARTIFICIAL CANDLE AND ITS LIGHT BULB

BACKGROUND OF THE INVENTION

1. Field of the Invention

The present invention relates to artificial candles, and specifically relates to an artificial candle with glowing artificial candle flame (light bulb).

2. Description of Related Art

Artificial candles are electronic devices having an appearance similar to candles. An artificial candle does not burn and produce real flame, thus there is no fire hazard, and users do not need to replace new candles when a candle is burned out. Artificial candles are typically used for window display, decorative lighting, etc.

China Pat. Pub. No. 2037710820 to Weiming Zhu published Aug. 13, 2014 and entitled "Simulation Candle" discloses a simulation candle including a lamp base, a lampshade and a lamp body fixed on the lamp base and located in the lampshade. The lampshade includes an inner flame cover and an outer flame cover wrapping the inner flame cover, and the transparencies of the inner flame cover and the outer flame cover are different, thus a flame effect is accordingly achieved. However, the inner flame cover is secured at the lamp body with a lower part of the lamp body without being covered by the inner flame cover, thus a lower part of the simulation flame of Weiming Zhu is brighter than an upper part, which is the opposite to a real candle flame. Thus a simulation effect is not ideal.

US Pat. App. Pub. No. 20070223216 A1 to Jensen et al published Sep. 27, 2007 discloses an artificial candle including an elastically flexible translucent flame piece simulating a candle flame and a base simulating a wax candle. The base includes a tube and an LED lamp housed in and supported by a cup-shaped nub at the top of a tubular post, thus light emitted from the LED lamp are restricted to an upper direction of the lamp, and the post simulating a wick is completely not brightened. However, a wick in a real candle will be brightened when the real candle is burning. Thus a simulation effect is not ideal.

Therefore, there is a need to provide an improved light bulb used on an artificial candle.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawings, in which.

Figure 1:
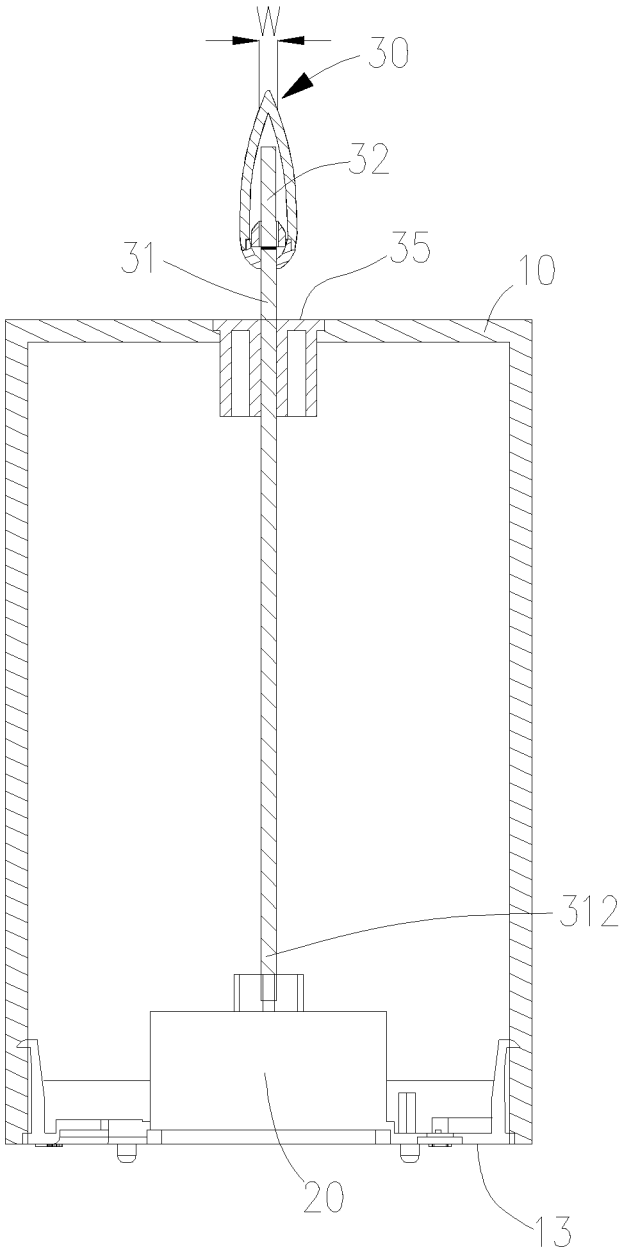
FIG. 1 is a partial cross-sectional view of an artificial candle in accordance with an embodiment of the invention.
Figure 3:
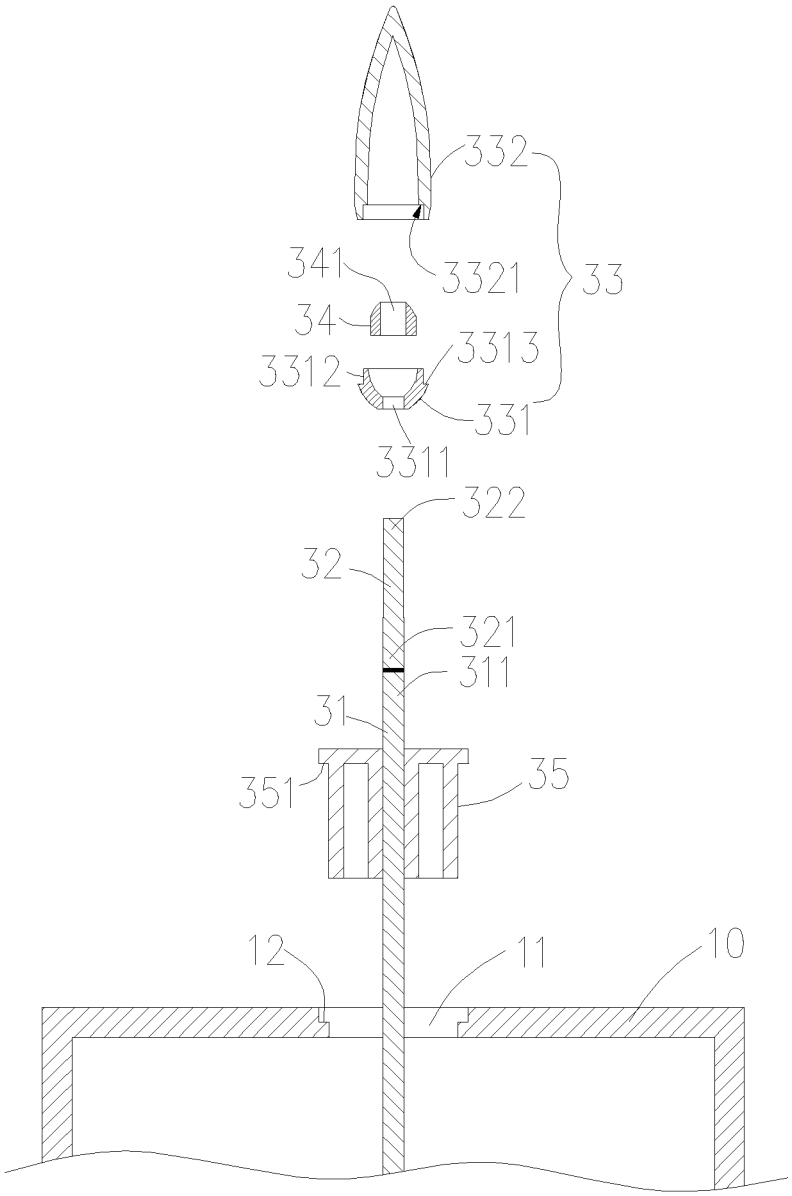
Figure 4A:
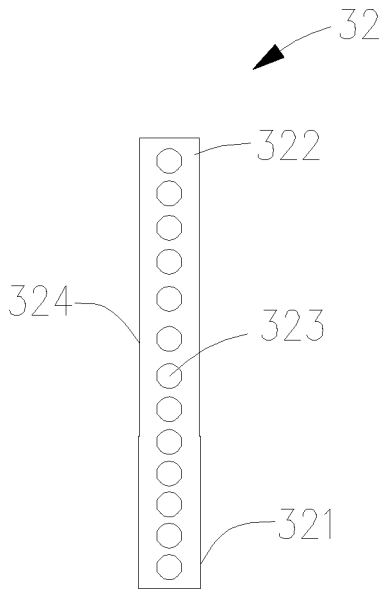
Figure 4B:
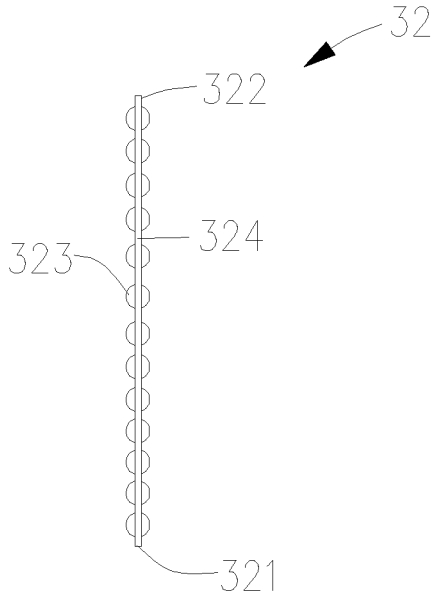

FIG. 3 is an exploded view of the artificial candle of FIG. 1. FIG. 4A is a front view of a light source of a light bulb of an artificial candle in accordance with an embodiment of the invention. FIG. 4B is a side view of the light source of FIG. 4A.

DETAILED DESCRIPTION OF THE INVENTION

The invention will now be described in detail through several embodiments with reference to the accompanying drawings.

An artificial candle of the present invention includes a hollow cylinder used for simulating a wax candle, a light bulb used for simulating a candle flame, and an electric wire connected between the light bulb and the cylinder. The electric wire has a substantially black sheath for simulating a candle wick. The light bulb is capable of emitting light that has three distinct regions. A lowermost and darkest zone, directly above an exposed section of the electric wire, simulates a zone of a candle flame that contains wax that has been vaporized but that is unburnt, thus it is the darkest zone. A middle zone is yellow and luminous to simulate a similar zone, an oxygen depleted zone of a candle flame. A highest and darker zone simulates a similar zone, a topmost zone of a candle flame, which is brighter than the lowermost and darkest zone and darker than the middle zone. For convenience of description, a vertical axis is defined, and a peak of the light bulb is defined as a highest point of the artificial candle.

Figure 2:
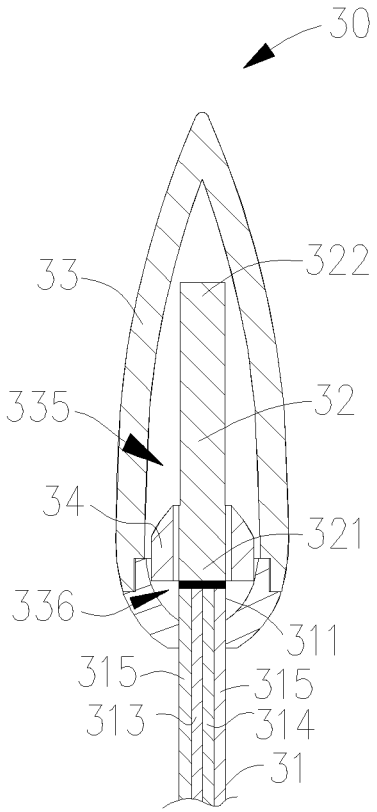
FIG. 2 is an enlarged cross-sectional view of a light bulb of the artificial candle of FIG. 1.

Please refer to FIG. 1 to FIG. 3, an artificial candle in accordance with an embodiment of the invention mainly includes a hollow cylinder 10 used for simulating a wax candle, a light bulb 30 used for simulating a candle flame, and a power source 20 used for supplying power for the light bulb 30 and mounted in the cylinder 10.

The light bulb 30 includes an electric wire 31, a light source 32, a hood 33 and an inner cover 34.

The electric wire 31 has a first end 311 and a second end 312, and includes two stranded wires 313, 314 sheathed in the substantially black sheath 315. Understandably, the two stranded wires 313, 314 are insulated with each other in the sheath 315. Understandably, other types of electric wires can be used in other embodiments.

The light source 32 has a long strip shape, and its first end 321 is electrically connected to the first end 311 of the electric wire 31. That is, the two stranded wires 313, 314 are electrically connected to pins (maybe a positive terminal and a negative terminal) of the light source 32. Preferably, the light source 32 is such designed that when it is powered, the whole of the light source 32, from its first end 321 to its free end 322, seems to give out light, like a shining rod. The light source 32 may include, for example but not limited, several SMD (Surface Mount Device) LEDs 323 mounted on two sides of a long strip-shaped base 324, as shown in FIG. 4A and FIG. 4B. The light source 32 and the electric wire 31 are aligned along the vertical axis, or in other words, at least a part, including the first end 311 of the electric wire 31 and the light source 32 can be considered in a straight line.

The hood 33 includes a cup 331 and an outer cover 332 covered on the cup 331 to define a first receiving space receiving the light source 32 and the first end 311 of the electric wire 31. A through hole 3311 is defined through a bottom of the cup 331. The first end 311 passes through the through hole 3311 and the electric wire 31 is secured to an edge/side defining the through hole 3311 at a position near the first end 311. Therefore, a part, including the first end 311 of the electric wire 31 is received in the hood 33. An annular wall 3312 extends upwardly from an upper edge of the cup 331 and has an outer diameter smaller than that of the upper edge of the cup, thus forming a step portion 3313. Accordingly, a corresponding inner step portion 3321 is formed at an inner side of the lower edge of the outer cover 332. The annular wall 3312 inserted in the outer cover 332 with the step portion 3313 contacting the lower edge of the outer cover 332. Preferably, the outer cover 332 is stuck to the cup 331 via adhesive.

The outer cover 332 has a shape similar to a candle flame, that is, a substantially conically shape, but its side curves are arched. The free end 322 of the light source is close to an upper end (peak) of the outer cover 332, such that the light emitted from the outer cover 332, except the topmost zone, is approximately homogeneous.

The inner cover 34 defines a through hole 341, and has an inner diameter larger than an outer diameter of the light source 32, and an outer diameter smaller than an inner diameter of the annular wall 3312 of the cup 331. By setting sizes of the inner cover 34, the cup 331, the part of the electric wire 31 located in the hood 33, the inner cover 34 is sleeved on the first end 321 of the light source 32 without touching and is supported by the cup 331 to separate the first receiving space into an upper space 335 and a lower space 336. Over a half part of the light source 32 passes through the through hole 341 in the inner cover 34 into the upper space 335. The inner cover 34 is used for reflecting light emitted from the part of the light source 32 received between the inner cover 34 and the cup 331 towards the wire holder 35 and the exposed part of the electric wire 31. The connection points between the light source 32 and the electric wire 31 is preferably located at a position where light emitted from the light source 32 can not directly come toward the sides (directions perpendicular to the vertical direction) of the cup 331, but are reflected towards the lower side of the light bulb 30. Therefore, a receiving space is defined by the inner cover 34 and the cup 311 and receives a part of the first end 321 of the light source 32 and the first end 311 of the electric wire 31.

A light transmittance of the inner cover 34 is smaller than that of the outer cover 332, and a light transmittance of the outer cover 332 is smaller than that of the cup 331. In the embodiment, the inner cover 34 is substantially black or dark grey, the cup 331 is colorless and transparent, and the outer cover 332 is cream-colored and made from high impact polystyrene. Therefore light transmitted of the inner cover 34 is less than that of the outer cover 332, and light transmitted of the outer cover 332 is less than that of the cup 331.

In operation, the light source 32 becomes bright like a shining rod when it is powered on. Thus the outer cover 332 is brightened to form the above described middle zone which simulates the oxygen depleted zone of a candle flame. Because the side wall of the outer cover 332 is converged to form the peak of the outer cover 332, a thickness (labeled as W in FIG. 1) of the peak is larger than that of the side wall accordingly, therefore less light is transmitted from the peak than that from the other part of the side wall of the outer cover 332, the above described highest and darker zone, simulating the topmost zone of a candle flame, near the peak of the outer cover 332 is formed. Depending on the inner cover 34, light emitted from the first end 321 of the light source 32 is blocked and reflected by the inner cover 34 towards the lower side of the light bulb 30, therefore, the lowermost and darkest zone is formed directly above an exposed section of the electric wire 31, and the exposed section of the electric wire 31 and a center part of the upper surface of the candle are illuminated, just like what happens in a real wax candle.

The cylinder 10 defines an opening 11 in its upper surface, and a sunken step structure 12 is formed at an edge defining the opening 11. A wire holder 35 having a flange 351 matching with the sunken step structure 12 is inserted in the cylinder 10 via the opening 11 and seals the opening 11. The wire holder 35 is used for holding the electric wire 31 at a position near the first end 311 of the electric wire 31, such that a part of the electric wire 31 protrudes out of the hollow cylinder 10. The wire holder 35 defines a through hole in its central part, the electric wire 31 is fixed within the through hole and cannot move within it. The exposed electric wire 311 between the cup 331 and the wire holder 35 is 1~2 millimeters and is used for simulating a candle wick. In the embodiment, the cylinder 10 is made from wax, and the wire holder 35 is made from plastic.

The cylinder 10 also defines an opening in its bottom (the other end of the cylinder 10), and a bottom cover 13 covers the bottom and seals the opening. The power module 20 is positioned on the inner side of the bottom cover 13 and electrically connected to the second end 312 of the electric wire 31.

In another embodiment, the power module 20 can be configured to act as the bottom cover, under this condition the power module 20 is inserted in the bottom end of the cylinder 10, thus the bottom cover 13 in the above embodiment can be omitted.

In the embodiment, the cup 331 is colorless and transparent, in other embodiments, the cup may have color and/or be transparent or semitransparent, so long as the reflected light from the inner cover can be projected to the wire holder and the exposed electric wire.

In the embodiment, the outer cover is cream-colored and made from high impact polystyrene, in other embodiments, the outer cover may be made from other type of plastics, and its color may be milk white or yellow white.

In other embodiments, the electric wire may be detachably connected with the power module via a plug and socket assembly.

In other embodiments, light transmitted of the outer cover 332 may be equal to that of the cup 331.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. An artificial candle, comprising:

a hollow cylinder configured for simulating a wax candle;

an electric wire with a substantially black sheath for simulating a candle wick;

a wire holder inserted in the hollow cylinder and holding the electric wire with a part of the electric wire protruding out of the hollow cylinder;

a power module configured in the hollow cylinder and electrically connected with the electric wire; and a light bulb configured for simulating a candle flame, the light bulb comprising:

a long strip shaped light source electrically connected with a first end of the electric wire, the first end of the electric wire protruding out of the hollow cylinder;

a cup defining a through hole, sleeved on and fixed to the electric wire at a position near the first end of the electric wire;

an outer cover connected to an upper edge of the cup to define a first receiving space for the light source; and an inner cover supported by the cup to separate the first receiving space into an upper space and a lower space and defining a hole extending there-through to communicate the upper space and the lower space;

wherein there is a distance between the cup and the wire holder, thus a part of the electric wire is exposed between the cup and the wire holder and the light bulb are supported by the electric wire above the hollow cylinder;

wherein over a half part of the long strip shaped light source passing through the hole in the inner cover into the upper space.

2. The artificial candle of claim 1, wherein the exposed part of the electric wire between the cup and the wire holder and a center part of an upper surface of the hollow cylinder are illuminated by the other part of the long strip shaped light source which is received in the lower space.

3. The artificial candle of claim 2, wherein the light source and the electric wire are aligned along an axis, and the inner cover is configured for reflecting at least a portion of light emitted from the part of the light source received in the second receiving space towards the wire holder and the exposed part of the electric wire.

4. The artificial candle of claim 3, wherein the cylinder further defines a second opening in the other end thereof, a bottom cover covers the other end of the cylinder and seals the second opening; the power module is settled on the bottom cover.

5. The artificial candle of claim 3, wherein the outer cover is cream-colored and made from plastic; the light source comprises a long strip-shaped base and a plurality of SMD LEDs mounted on two sides of the long strip-shaped base.

6. The artificial candle of claim 3, wherein the outer cover is cream-colored and made from high impact polystyrene.

7. The artificial candle of claim 3, wherein a diameter of the through hole of the inner cover is larger than an outer diameter of the sheath of the electrical wire, the inner cover is substantially black or dark grey, the cup is colorless and transparent.

8. The artificial candle of claim 7, wherein the cup is transparent or semitransparent.

9. The artificial candle of claim 2, wherein the cup is colorless and transparent; a light transmittance of the inner cover is smaller than that of the outer cover, and the light transmittance of the outer cover is smaller than that of the cup, a horizontal thickness dimension of a peak of the outer cover is larger than that of a side wall of the outer cover, such that, in use, the peak portion of the outer cover simulates the topmost zone of a candle flame, a portion of the outer cover not overlapping with the inner cover simulates the oxygen depleted zone of the candle flame, and a portion of the outer cover overlapping with the inner cover and the cup simulate the vaporized and unburning zone of the candle flame.

10. A light bulb of an artificial candle, comprising:

an electric wire with a substantially black sheath for simulating a candle wick;

a long strip shaped light source electrically connected with one end of the electric wire;

a cup defining a through hole, sleeved on and fixed to the electric wire at a position near the one end of the electric wire;

an outer cover connected to an upper edge of the cup to define a first receiving space for the light source and the one end of the electric wire;

a wire holder holding the electric wire; and an inner cover supported by the cup to separate the first receiving space into an upper space and a lower space and defining a hole extending there-through to communicate the upper space and the lower space;

wherein there is a distance between the cup and the wire holder, thus a part of the electric wire is exposed between the cup and the wire holder and the light bulb are supported by the electric wire;

wherein over a half part of the long strip shaped light source passing through the hole in the inner cover into the upper space.

11. The light bulb of claim 10, wherein the exposed part of the electric wire between the cup and the wire holder and a center part of an upper surface of the hollow cylinder are illuminated by the other part of the long strip shaped light source which is received in the lower space.

12. The light bulb of claim 11, wherein the inner cover is configured for reflecting at least a portion of light emitted from the part of the light source received in the second receiving space towards a central part of the cup and the exposed part of the electric wire outside of the first receiving space.

13. The light bulb of claim 12, wherein the light source and the electric wire are aligned along an axis; the light source comprises a long strip-shaped base and a plurality of SMD LEDs mounted on two sides of the long strip-shaped base.

14. The light bulb of claim 13, wherein the outer cover is cream-colored and made from high impact polystyrene.

15. The light bulb of claim 13, wherein a diameter of the through hole of the inner cover is larger than an outer diameter of the sheath of the electrical wire, the inner cover is substantially black or dark grey, the cup is colorless and transparent.

16. The light bulb of claim 11, wherein the cup is colorless and transparent; a light transmittance of the inner cover is smaller than that of the outer cover, and the light transmittance of the outer cover is smaller than that of the cup, a horizontal thickness dimension of a peak of the outer cover is larger than that of a side wall of the outer cover, such that, in use, the peak portion of the outer cover simulates the topmost zone of a candle flame, a portion of the outer cover not overlapping with the inner cover simulates the oxygen depleted zone of the candle flame, and a portion of the outer cover overlapping with the inner cover and the cup simulate the vaporized and unburning zone of the candle flame.

17. An artificial candle, comprising:

a hollow cylinder configured for simulating a wax candle;

an electric wire configured for simulating a candle wick;

a wire holder inserted in one end of the cylinder and holding the electric wire at a first position near a first end of the electric wire;

a power module inserted in the other end of the cylinder and electrically connected with a second end of the electric wire; and a light bulb configured for simulating a candle flame, the light bulb comprising:

a light source with a long strip shape and with a first end electrically connected with the first end of the electric wire, the light source and the electric wire being aligned along an axis;

a cup defining a through hole allowing the electric wire to pass through and secured to the electric wire at a second position closer to the first end of the electric wire than the second end of the electric wire;

an outer cover connected to an upper edge of the cup to define a first receiving space for the light source and the first end of the electric wire; and an inner cover defining a through hole, sleeved on the first end of the light source and supported by the cup to separate the first receiving space into an upper space and a lower space;

wherein light transmitted through the inner cover is less than that of the outer cover and that of the cup;

wherein over a half part of the long strip shaped light source passing through the hole in the inner cover into the upper space.

18. The artificial candle of claim 17, wherein there is a distance between the cup and the wire holder, thus a part of the electric wire is exposed, and the electric wire includes a substantially black sheath; the exposed part of the electric wire between the cup and the wire holder and a center part of an upper surface of the hollow cylinder are illuminated by the other part of the long strip shaped light source which is received in the lower space.

19. The artificial candle of claim 18, wherein a diameter of the through hole of the inner cover is larger than an outer diameter of the sheath of the electrical wire, the inner cover is substantially black or dark grey, the cup is colorless and transparent.

20. The artificial candle of claim 19, wherein the outer cover is cream-colored and made from high impact polystyrene; the light source comprises a long strip-shaped base and a plurality of SMD LEDs mounted on two sides of the long strip-shaped base.

* * * * *